US005561417A

United States Patent [19]

Rothbaum et al.

[11] Patent Number: 5,561,417

[45] Date of Patent: Oct. 1, 1996

[54] SECURITY DEVICE FOR MERCHANDISE AND THE LIKE

[75] Inventors: Arthur H. Rothbaum, Northport; Richard S. Goldblatt, Kings Park, both of N.Y.

[73] Assignee: Protex International Corp., Bohemia, N.Y.

[21] Appl. No.: 174,389

[22] Filed: Dec. 28, 1993

[51] Int. Cl.[6] ..... G08B 13/14

[52] U.S. Cl. ..... 340/568; 340/687

[58] Field of Search ..... 340/568, 687

[56] References Cited

U.S. PATENT DOCUMENTS

| | | | |
|---|---|---|---|
| 3,127,597 | 3/1964 | Lewin et al. | 340/568 |
| 3,253,270 | 5/1966 | Downer | 340/568 |
| 3,596,265 | 7/1971 | Garland | 340/568 |
| 4,293,852 | 10/1981 | Rogers | 340/568 |
| 4,620,182 | 10/1986 | Keifer | 340/687 |
| 4,746,909 | 5/1988 | Israel et al. | 340/568 |
| 5,066,942 | 11/1991 | Matsuo | 340/568 |
| 5,153,567 | 10/1992 | Chimento | 340/691 |
| 5,172,098 | 12/1992 | Leyden et al. | 340/568 |
| 5,345,220 | 9/1994 | Wachsman | 340/568 |

FOREIGN PATENT DOCUMENTS 1730092 3/1992 Australia .

*Primary Examiner*—Glen Swann
*Attorney, Agent, or Firm*—Eugene E. Renz, Jr.

[57] ABSTRACT

An electronic security system for monitoring merchandise sounds an alarm when a change in the state of the sensors or the electrical connections is detected. The system eliminates the need for shunt plugs and other extraneous components in favor of a self-contained solid state electronic circuit. The security system includes a lid which deactivates the alarm when the lid is open. When the lid is closed, the alarm is activated and physical tampering with the electrical connections.

13 Claims, 5 Drawing Sheets

SECURITY DEVICE FOR MERCHANDISE AND THE LIKE

FIELD OF THE INVENTION

The present invention generally relates to security systems, and more specifically to electronic security systems used in retail stores, offices, hotels and other establishments to prevent the theft of merchandise.

BACKGROUND OF THE INVENTION

Various types of security systems to protect retail goods on display in a store are known throughout the trade. The basic components of the system include a sensor which is attached to each item of merchandise intended to be protected, a switch within the sensor which generates an alarm signal, splitter boxes or similar modular connecting units for receiving signals from the sensors, and an alarm box which is connected to the splitter boxes through various conducting cables and which houses an alarm.

Merchandise security systems can be broadly classified into two groups, closed loop and open loop systems. In a closed loop security system, current constantly flows from the alarm box to the sensor. The sensor switch is in a normally open state, i.e., a non-conducting state. Depressing the actuator of the switch would place the switch in a closed state, i.e., a conducting state. The sensor is attached to the article in such a manner that the actuator of the switch is depressed, placing the switch in its closed state, i.e. the contacts of the switch make or are electrically connected. After a sensor is attached to each item of merchandise, the alarm circuit is armed or set, usually with a key switch. When armed, the alarm box circuitry sends out a continuous current through the splitter boxes and sensor switches; the current then returns to the alarm box circuitry. A complete electrical circuit is formed when the switch is closed as a result of its attachment to an item of merchandise. As long as no cables are cut and the actuator remains depressed, a complete electrical circuit is made and the security system remains in its armed state.

During an unauthorized removal of the sensor, the actuator is distended, which opens the switch contacts and which breaks the closed loop circuit. Similarly, if a cable is cut the continuous current to the sensor is interrupted. The alarm box circuitry detects that the current has been interrupted and an alarm will sound. The alarm notifies store personnel that there has been a security breach.

A typical closed loop alarm system is disclosed in U.S. Pat. No. 4,746,909 (the '909 patent), issued May 24, 1988. The '909 patent discloses an electronic security system including a single control box, series connected modular sensor units, and conductive loop sensors attached to the modular monitoring units. A closed loop circuit is formed through the conductive loop sensors. The unauthorized removal of an item of merchandise will break or disconnect the conductive loop. This closed loop circuit will be broken; this disruption will be detected by the monitoring circuit which activates the alarm. A time-out circuit within the control box is used to determine the period of time in which the alarm is activated.

U.S. Pat. No. 3,253,270 discloses a battery-powered alarm in which separate long leads are connected to each of the goods to be protected. A first battery is used to power a detection circuit and a second battery is used to power an alarm circuit. A resistor is included with each sensor. The resistance of each sensor resistor must be substantially identical to the resistance of an internal circuit resistor. During a security breach, the current in the line will change, thus affecting the calibration of a meter in the detection circuit. When the needle of the meter is deflected far enough, an alarm is sounded.

The '270 patent also discloses a box to house the alarm circuitry. The box includes a lid which can be locked to the box. The lid is locked after the meter is adjusted to prevent tampering with the alarm system.

Another example of a closed loop system is U.S. Pat. No. 5,172,098, issued Dec. 18, 1992. The '098 patent discloses sensor switches on each sensor. During a security breach, the switch opens, breaking the closed loop. Detection circuitry determines that a security breach has occurred and turns on an audio and visual alarm.

The assignee of the '098 patent has developed several other closed loop security systems which operate in a manner similar to the '098 patent. For example, their Kord Kontrol® strip alarm system is another closed loop system. The Kord Kontrol® strip alarm is powered by two nine volt batteries with an AC adapter option. A switch within each sensor activates the alarm horn.

The assignee of the present application also has developed closed loop security systems. For example, the Electronic Merchant Guard (EMG-32) can be used with mechanical cables or electronic cables. The mechanical cables physically secure merchandise to a stationary box; the electronic cables carry a small DC voltage to electronic sensors which electrically secure merchandise. When merchandise is electrically secured, an alarm is sounded upon the detection of a security breach. The Electronic Merchant Guard houses the electronic circuitry in the same stationary box to which the mechanical cables are secured. A cover on the stationary box prevents tampering of the circuitry and locks the mechanical cables to the stationary box.

The assignee of the present application also manufactures SECURTRON (ES-24) which is a closed loop security system. The SECURTRON is easily adaptable to any fixture or wall system. Sensor clips or electronic cables are attached to the items or goods to be protected. The alarm circuitry is electronically connected to the sensor clips forming a closed loop circuit. When the cable is cut or is improperly removed, or when the security clip is removed without authorization, an alarm is activated.

A drawback of all closed loop security systems is that current must constantly flow. Accordingly, power must be supplied to the conductive loop or to the sensor switch at all times. Usually, the most feasible way to do this is to provide power via an AC/DC adapter. This presents a problem during power outages. Also, many stores turn off all power to the retail floor space at night or when the store is closed.

Battery backups have been designed to supply the necessary current; however, the current draw on the batteries is often too great to supply current for extended periods of time. This leaves the merchandise unprotected from unscrupulous security guards and support personnel (janitors, stock boys, etc.). In addition, batteries would need to be checked and replaced on a regular basis, increasing the maintenance of the security system. Recently, the situation has become more acute with the use of light emitting diodes (LEDs) on the splitter boxes and on the sensors. The LEDs add to the current drain making a battery back-up system an even less viable option.

Another drawback of many closed loop security systems is that they require jumpers or shunt plugs on the splitter box connections which are not connected to merchandise. The shunt plugs form an electrical connection to prevent the alarm from sounding when the system is armed. Shunt plugs increase the cost of the system and are also a source of misconnections if improperly installed. Further, shunt plugs must constantly be installed and removed as the items of merchandise are sold or as stock is replaced. Accordingly, the shunt plugs increase the amount of time store personnel must spend attending to the security system. In addition, if the required shunt plugs are lost or not installed properly the security system is inoperable since the alarm will sound continuously.

An open loop security system operates in a similar fashion to a closed loop system. However, the sensor switch would be normally closed, i.e. when the actuator is distended. When the sensor is properly attached to the merchandise, the actuator is depressed, opening the switch; this prevents current from flowing. If there is a tampering of the sensor switch, the actuator distends, the switch contacts close and current flows through the sensor switch. A continuous circuit is made when the sensor switch closes, activating the alarm.

In an open loop security system, the alarm does not sound unless a circuit is completed. Normally, the only way to complete the circuit is to remove the sensor from the article. Therefore, an open loop security system may be circumvented by cutting the sensor cable or removing the sensor cable plug from its jack. In this manner, the article may be stolen without the alarm sounding. Since open loop systems are easier to circumvent, they are not as popular as closed loop systems.

An open loop security system is disclosed in U.S. Pat. No. 4,620,182. This device includes a special cable which is designed to short out its internal wires if the cable is cut. When this cable is cut or damaged, a complete circuit is made thereby activating the alarm.

In many of the closed loop and open loop systems merchandise can be added while the security system is armed; either no alarm or only a short alarm will be activated. Continual short bursts from an alarm horn may annoy customers. In addition, many of these systems may be susceptible to circumvention since a foreign object may be connected to the security system to override the alarm.

The use of alarm modules or splitter boxes in security systems increases the maintenance of the security system. Extra connections are required to incorporate these splitter boxes; these extra connections are a weak link that can be attacked by a thief. In addition, many security systems require jumpers on all unused connections. Further, splitter boxes are unsightly to look at, and are a source of misconnections and false alarms.

SUMMARY OF THE INVENTION

It is an object of the instant invention to provide an improved security system to protect merchandise and the like.

The instant invention is a closed loop security system. An alarm horn will sound and various LEDs will light upon the detection of a security breach. It is designed to conserve energy by lighting the necessary LEDs only during a security breach. In addition, the system is activated or deactivated by movement of the lid.

The present invention is a fully integrated security device and system to protect articles of merchandise within a retail store. The alarm and detection circuitry, the connections to the sensors, and the power supply are all located in one housing. Accordingly, the security system is an integrated or completely self-contained unit. The instant security device and system includes a plurality of electronic sensors which are attached to the items to be protected. Item cords or cables connect the sensors directly to the alarm circuit. The preferred connection means is to have plugs on the ends of the item cords. Mating jacks, located on the housing, ensure the proper electrical contact between the plugs and the detector circuit. Separate alarm modules or splitter boxes are not required.

The alarm circuit is housed in a single unit or strip and is usually remotely located from the protected items of merchandise. However, the system is completely self-contained and can be located almost anywhere, including directly attached to various display racks.

The present security system is powered by a battery contained within the housing and is designed to conserve energy. This eliminates a potential security problem since there is no AC/DC adapter nor is there a connection from the AC/DC adapter to the alarm circuitry. Further, a power outage in the retail store will not affect the operation of the security system.

A LED is associated with each sensor circuit and is located on the housing next to its respective item cord jack. The LED indicates a secure or non-alarm state by displaying a first color. In order to conserve the greatest amount of energy, the first color of the LED may be "off", indicating that the system is armed.

An alarm indicator light is on the housing at a location that is easily visible. The alarm indicator light turns on when the system is armed and a security breach is detected. The alarm indicator light may be an LED and is preferably large enough to catch the attention of store personnel from a distance. In order to make the indicating light even more noticeable, components can be chosen and designed to turn the indicator light on and off repeatedly, i.e. blinking, upon the detection of a security breach.

The present invention also includes a specially designed lid or cover. During normal operations, i.e. in its armed mode, the lid is mechanically locked to the housing. The lid contains holes so that all of the housing LEDs are visible. The lid also has holes to allow the item cords to pass through. When the lid is closed, it blocks access to the plugs and jacks, preventing an accidental or an unauthorized removal of the plugs from the jacks.

The lid is also designed to change the state of a switch or switches. The primary function of these switches is to control the circuitry of the security system and to place the security system in its proper mode.

When the lid is open, a switch or switches are actuated placing the security system in its SET-UP mode. The horn and the indicator light will be deactivated; the sensors can be properly affixed to the items of merchandise to be protected without the distraction of having the horn or indicator light being on.

When the lid is closed, the lid changes the state of the switches and the security system is on or ARMED. The horn and indicator light are activated but remain off; they will both turn on upon the detection of a security breach.

Upon the unauthorized removal of the sensor, the cutting of the item cable, or upon a similar security breach (i.e. the breaking of the closed circuit), the alarm will sound, the housing LED will change from its first color to a second or alarm color (e.g., off to on), and the indicator light will blink. After a security breach, the store personnel will be alerted to the particular security system which has been breached by the blinking LED and by the audio alarm. This feature is especially useful when there are many security systems within close proximity. The store personnel can determine the general location of the breach by approaching the direction of the horn sound and the blinking light. After locating the security system in which the breach took place, the store personnel scans the LEDs on the housing. The store personnel can immediately see which sensor was tampered with since the associated housing LED will be on.

The security personnel can deactivate the horn by unlocking and opening the lid. As the lid opens, the switches are activated, turning the horn and the indicating light off; however, the circuitry design allows the housing LED to remain lit.

The present security system is designed to physically and electronically protect the connections of the sensor to the housing. Store personnel cannot connect merchandise to the instant security system unless the key to the lid is obtained from authorized personnel. In addition, the present security system's SET-UP mode cannot be overriden unless the key is obtained.

LEDs may also be placed within the sensor housing to provide a visual warning to a potential thief that the item of merchandise is protected by a security system. However, sensor LEDs will add an additional current drain on the battery.

BRIEF DESCRIPTION OF THE DRAWINGS

Other objects and advantages of the present invention will become apparent from the following detailed description, when taken in conjunction with the accompanying drawings, wherein.

DETAILED DESCRIPTION OF THE PREFERRED EMBODIMENT

Figure 1:
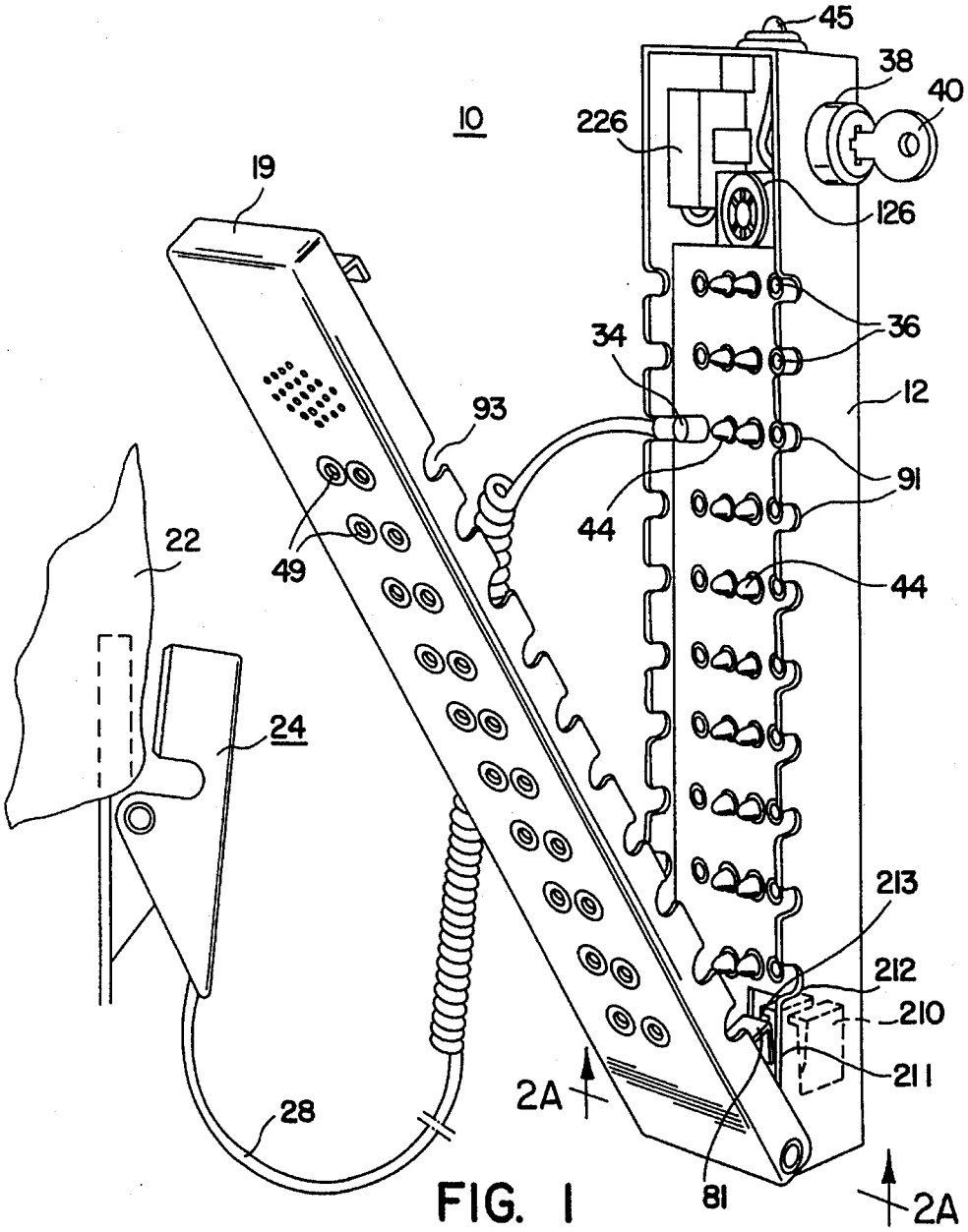
FIG. 1 is a perspective view illustrating the various components comprising the electronic security system, shown in accordance with this invention.

The security system of the present invention is an advanced electronic cabling system which is adapted for use in protecting merchandise displayed in a retail store. The system can protect almost any item with the proper sensor, however it is particularly suited to protect soft goods, e.g. clothing. Referring now to the drawings, a security system, according to the instant invention, includes at least one sensor, e.g. an electronic cable or an electronic security clip, along with an alarm circuit; one such security system being designated in its entirety by reference numeral 10.

The security system circuitry will detect a security breach by turning on a housing LED to indicate exactly which circuit has been broken (i.e., a sensor has been tampered with, or a cord or cable has been cut), and activating an alarm (visual, audio or both) to attract the attention of the store personnel. The system circuitry will also "remember" when a sensor circuit has been opened such that an alarm condition cannot be reset by reconnecting the sensor.

Referring to FIG. 1, a security system 10 in accordance with the present invention is shown. The number of jacks corresponds roughly to the number of items of merchandise that can be protected. One skilled in the art could replicate the circuitry to make a security system to protect any number of items.

The preferred embodiment envisions the security system having twenty jacks 36, as illustrated. A housing 12 contains virtually all of the circuitry. This self-contained or integrated approach eliminates the need for splitter boxes. Also, the system is designed to run on a battery 226 located within the housing 12. Accordingly, the number of false alarms and misconnections are reduced since no external connection to an AC/DC adapter is required.

Typically, battery 226 is a single nine volt battery. Battery 226 provides all of the power needed for the security system. All references to the $V_1$ supply voltage means the voltage supplied by battery 226.

It should be noted that one skilled in the art could readily adapt the present security system for use with an AC/DC adapter. The AC/DC adapter can be hard-wired to the security system, or a plug/jack connection could be utilized. When using an AC/DC adapter, a power indicator light may be used to indicate that DC power is being properly supplied by the AC/DC adapter.

Store personnel decide which articles of merchandise 22 are to be protected. In the preferred embodiment, up to twenty items 22 of merchandise may be selected for protection; this corresponds to a one-to-one relationship with the number of jacks 36 located on the housing 12. However, variations are readily designed.

It should be noted that the system is still operable when less than all jacks 36 are used. Further, if there are less than twenty items 22 to be protected, jumpers or shunt plugs are not required to be inserted into the unused jacks 36.

The location of housing 12 is determined by a variety of factors, including the location of the items 22 of merchandise to be protected and the length of an item cord 28. Other factors which may be considered are the convenience of store personnel, a desire to keep the housing 12 visible from a distance, and for aesthetic purposes. Although the housing 12 is shown in a vertical orientation, it may be mounted horizontally or in any other orientation without affecting the operation of the security system.

The present security system 10, may be used to protect hard goods (TVs, VCRs, computers, telephones, etc.) However, it is particularly adapted to be used in protecting soft goods, including coats, suits, skirts, dresses, and other articles of clothing. The sensor used in conjunction with this security system depends on the type of merchandise to be protected.

For purposes of illustration, the security clip 24, as seen in FIGS. 1, 3, 4A, 5 and 6, will be used to describe the operation of the security system. However, one skilled in the art would readily understand that this security system 10 will work with any sensor that has a two-state or binary component (on/off); for example conductive loops (see FIGS. 3, 4B and 4C), specially adapted computer plugs and RCA-type plugs, and other sensors which can be easily designed to work with the instant invention.

Figure 4A:
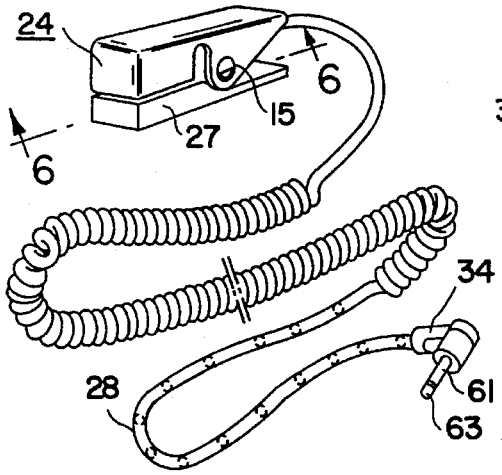
FIGS. 4A–4C illustrate three types of sensors that may be utilized with the instant invention.
Figure 4B:
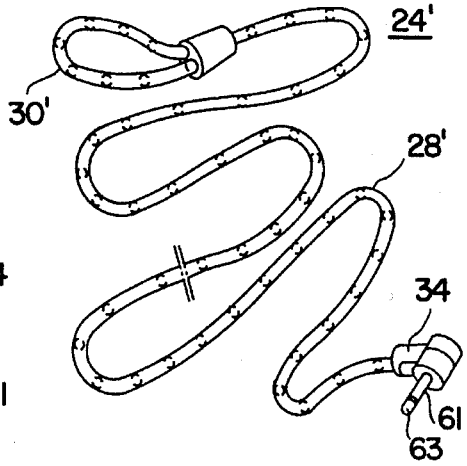

In FIG. 4B, an example of a closed circuit electrically conductive loop 24' is illustrated. Item cord 28' is straight and contains two wires. The loop portion 30' connects the ends of the two wires contained by item cord 28'. Current flows from the detection circuit, through one wire of item cord 28', through loop 30' and back to the detection circuit through the second wire of item cord 28' forming a closed loop circuit. Loop portion 30' will physically break upon the application of excessive pressure, which electrically breaks the closed loop circuit, thereby activating the alarm.

Figure 4C:
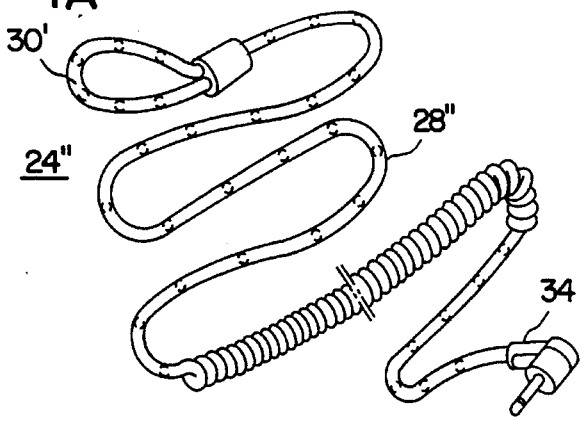

The closed circuit electrically conductive loop 24" of FIG. 4C operates in a similar manner to the conductive loop 24' except that item cord 28" is coiled. Identically numbered components are interchangeable between the various sensors. For example, right angle plug 34 can be used with a security clip 24 or either closed circuit conductive loop 24' or 24". Similarly, loop 30' is identical on both electrically conductive loops 24' and 24".

Figure 5:
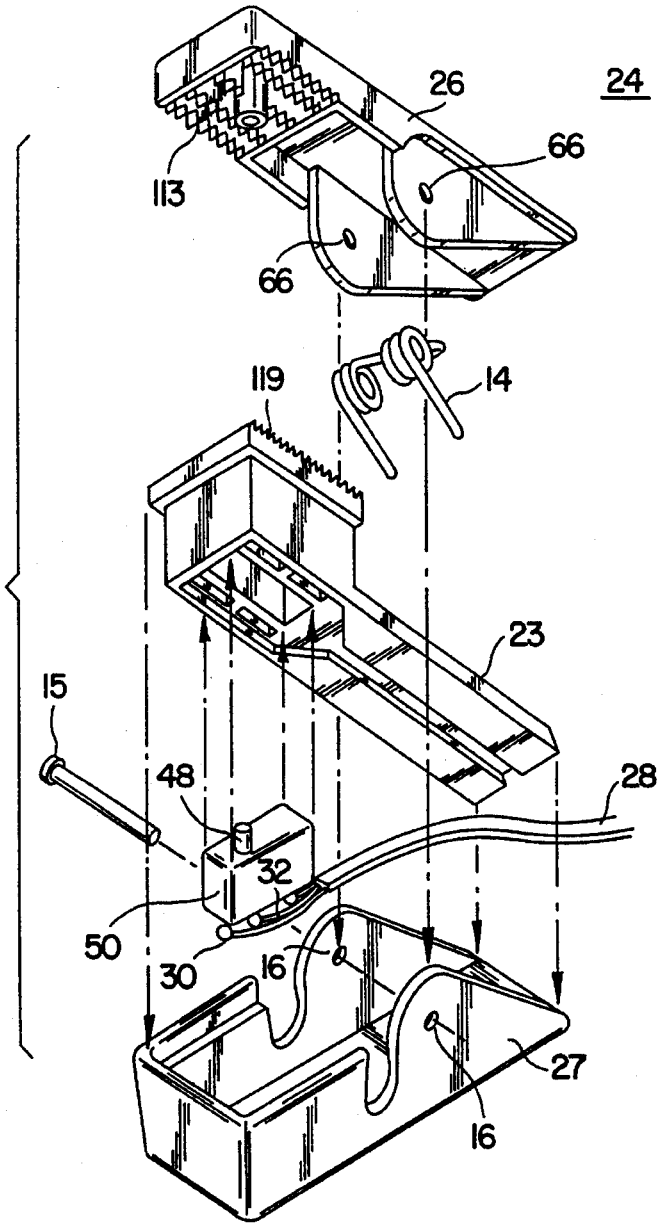
FIG. 5 is an exploded isometric view showing all of the component parts of the electronic security clip sensor prior to assembly.

Referring to FIG. 5, the individual elements of the clip device 24 are shown in an exploded view prior to assembly. The clip device 24 generally includes a lower jaw 23, a clip base 27, and an upper jaw 26. Lower jaw 23 is secured to clip base 27. Spring 14 is held in place by shaft 15. Holes 66 of upper jaw 26 and holes 16 of clip base 27 are designed to hold shaft 15, so that the jaw 26 pivots with respect to clip base 27. The spring 14 biases the jaws in a closed position.

Security clip 24 is connected to the item of merchandise 22. The clip 24 is attached by applying pressure on upper jaw member 26 in the direction of clip base 27 as shown by the large arrow in FIG. 6. This raises the upper jaw 26 and exposes actuator 48 of switch 50.

An item of merchandise is inserted between the open jaws 26, 23 of the clip 24. Pressure on upper jaw member 26 is released and the jaw faces 113 and 119 of upper jaw member 26 and lower jaw member 23, respectively, frictionally engage the item 22.

The item of clothing is held in place by pressure supplied by spring 14. Teeth or a non-slip material on either, or both, jaw faces 113 or 119 may also be used to more thoroughly secure the item 22. The bias provided by spring 14 along with the slip resistant surfaces of jaw faces 113, 119 prevent the accidental displacement of the item 22 from the jaws.

The switch 50 is connected to the system circuitry via wires 30 and 32 of item cord 28. Item cord 28 is of sufficient length to connect the clip 24 to the system circuitry located within housing 12. In the preferred embodiment, item cord 28 is coiled to allow for a longer length while minimizing entanglement.

Any connection means can be used to electrically connect the wires 30 and 32 of clip 24 to the security system circuitry. In the preferred embodiment, a two-contact plug 34 is used as shown in FIGS. 4A–4C and FIG. 9. Contact or terminal 61 is located at the base of plug 34 and contact 63 is located at the tip of plug 34. Plugs 34 are illustrated as having a right angle design, however any style plug may be used including straight plugs.

A mating jack 36 is mounted in the housing 12. The clip plugs 34 and the corresponding mating jack 36 are off-the-shelf items. Plug 34 is inserted into jack 36 to make the appropriate electrical connections. When plug 34 is fully inserted into jack 36, terminals 61 and 63 physically and conductively touch terminals 71 and 73 FIG. 8, respectively, of jack 36.

Cover or lid 19 serves two main purposes. First, cover 19 includes a plunger 81. When cover 19 opens and closes, plunger 81 activates switches 210 and 212 (see FIGS. 1, 2A, 2B and 7). Second, cover 19 is mechanically locked into place, preventing physical access to jacks 36 and any plugs 34 inserted into jacks 36. Accordingly, this prevents tampering with unused jacks 36, and the accidental or unauthorized removal of plugs 34 from jacks 36.

The state of the security system 10 depends on the position of cover 19. When cover 19 is opened or separated from the housing 12, the security system 10 is in its SET-UP mode. The security system 10 is activated or placed in its ARMED mode by the closure of cover 19.

The security system is "on" or in its ARMED mode when plunger 81 simultaneously engages the flexible metal bars 211 and 213 located on the tops of switches 210 and 212 respectively. Switches 210 and 212 are single-pole double-throw switches. Metal bars 211 and 213 contact the actuators of switches 210 and 212. The metal bars 211 and 213 provide a larger surface area for plunger 81 to engage the actuators of switches 210 and 212. When plunger 81 engages metal bars 211 and 213, the actuators of switches 210 and 212 are in turn depressed.

When lid 19 is closed, the security system 10 is ARMED and mechanical key lock 38 may be turned with key 40 to physically lock lid 19 to housing 12. If lid 19 is unlocked and opened, the actuators of switches 210 and 213 lift metal bars 211 and 213 and switches 210 and 213 change state.

The basic circuit operation will now be addressed. A single alarm circuit will be described, however one skilled in the art would understand that the circuit can be readily replicated to form a custom security system to protect any number of items of merchandise. In the preferred embodiment, the present security system is designed to have twenty jacks 36 on the housing 12. Each jack 36 is associated with its own separate closed loop circuit.

Figure 6:
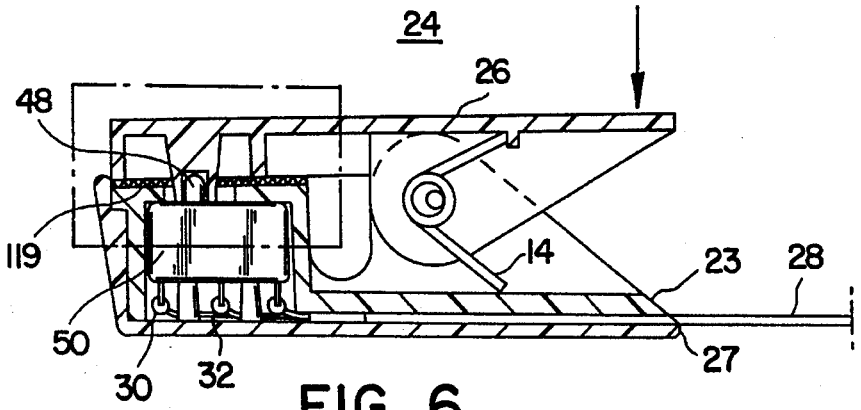
FIG. 6 is an enlarged sectional elevational view of an electronic security clip sensor taken along line 6—6 of FIG. 4A.

Referring to FIG. 6, clip 24 is shown in cross section. A single-pole single-throw switch 50 is the principle alarm signal generation means and is secured to the interior of the clip base 27. Actuator 48 of switch 50 is biased in a distended position above the plane of face 119, and switch 50 is normally open. When clip device 24 is properly attached to an article 22 of clothing FIG. 1, item 22 contacts actuator 48, keeping actuator 48 depressed below the plane of face 119; sensor switch 50 is closed forming a closed loop circuit.

The pressure supplied by spring 14 keeps item 22 in place. Various clip arrangements may be designed to secure an article of clothing. The article 22 of clothing is protected since it depresses the actuator 48, closing the contacts of switch 50.

When the actuator 48 of switch 50 is depressed, closing switch 50, electrical contact is made between wires 30 and 32. When switch 50 is closed, current flows from the system circuitry through plug 34, wire 30, switch 50, and wire 32 back to the system circuitry.

Figure 3:
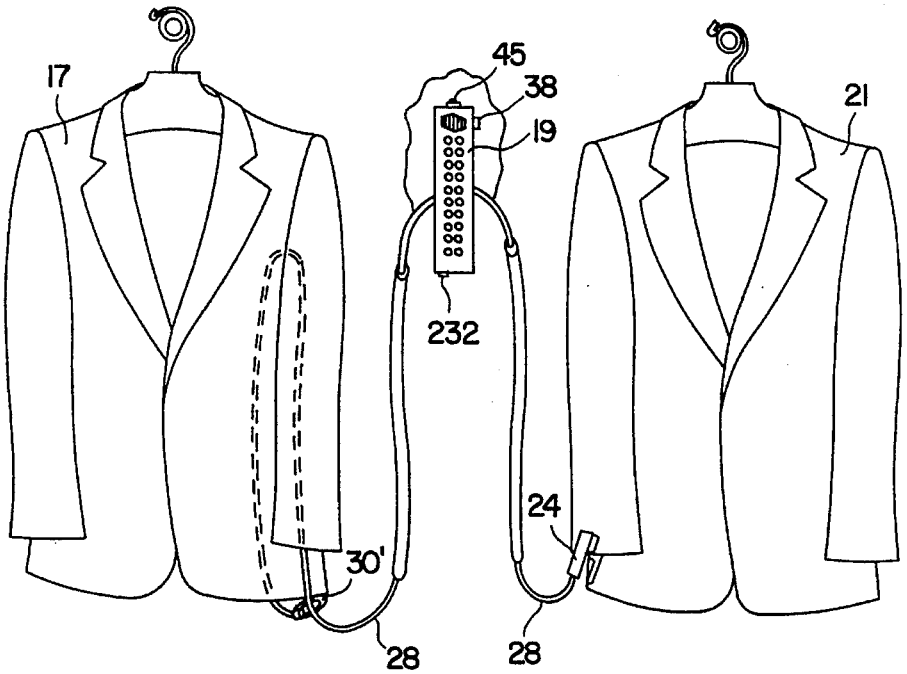
FIG. 3 is an elevational view illustrating two of the sensors (an electronic cable and a security clip) used to protect articles of clothing in accordance with the present invention.

If there is a security breach, for example when there is an unauthorized removal of the clip 24 from a jacket 21 FIG. 3, the actuator 48 distends above the jaw face 119 opening switch 50. This interrupts the current flow between wires 30 and 32. The system circuitry detects this interruption and an alarm is sounded. A thief cannot override the alarm by placing a foreign object between jaws 113 and 119, even if the foreign object again depresses actuator 48. The present security system 10 is designed to keep the alarm on until authorized personnel deactivate the alarm.

Other sensors may be used with the present security system having an operation similar to clip 24. For example, the electronic security cable 24" as shown in FIGS. 3 and 4C has a two-state operation. During normal operation, current flows from the alarm circuitry through conductive loop 30' back to the alarm circuitry. An unauthorized removal of an article of clothing 17 would require the breaking of loop 30' or the cutting of cable 28. This causes an open circuit which is detected by the security system and an alarm is again generated.

Figure 7:
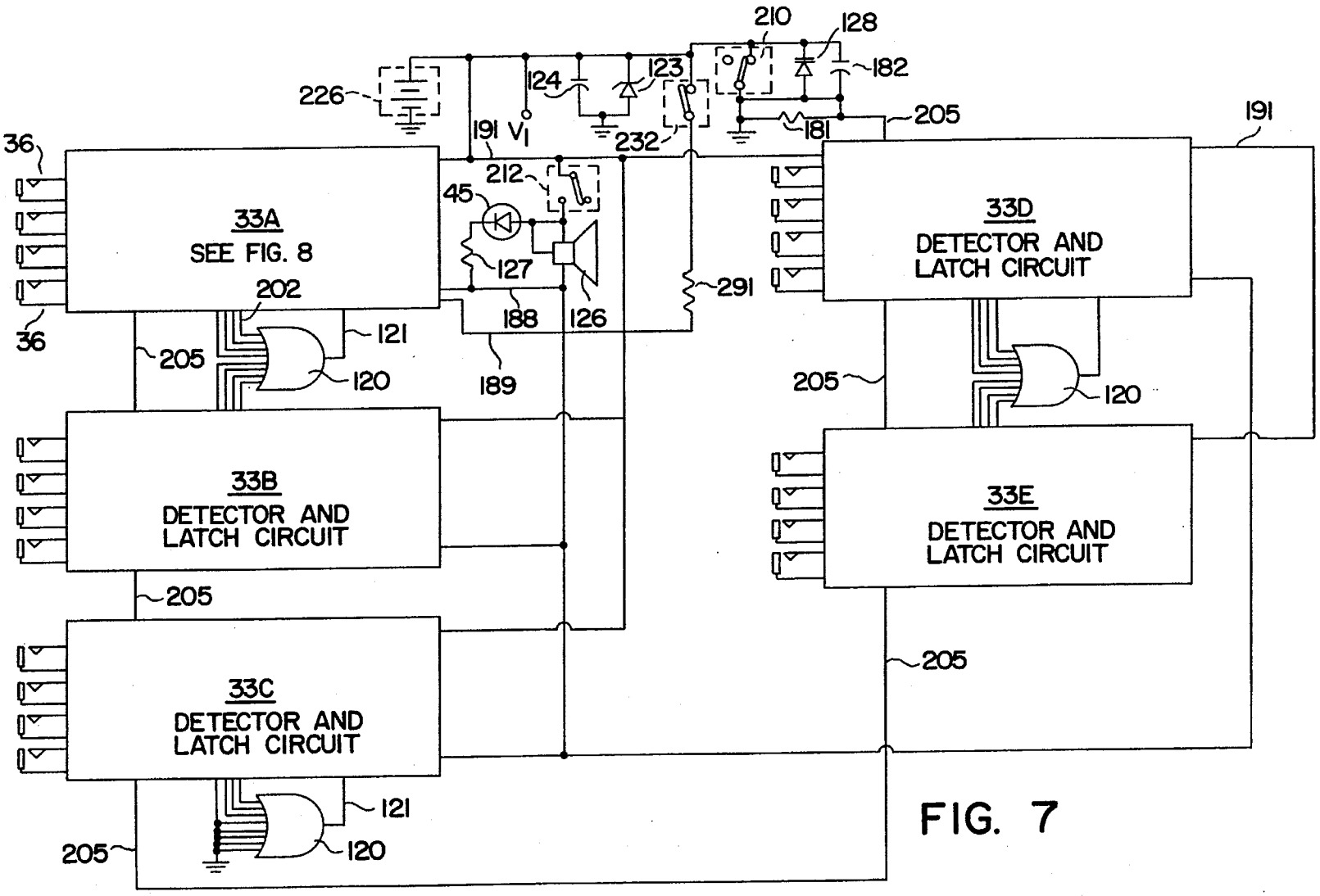
FIG. 7 is a partial schematic diagram of the security system according to the present invention.

With respect to FIG. 7, a partial schematic block diagram of the security system 10 is shown. Jacks 36 are separated into five groups of four. A single plug 34 may be inserted into each jack 36. However, twenty plugs 34 are not needed for the security system to operate. A single closed loop system is formed when only one plug 34 is inserted into jack 36.

Detector and latch circuits 33A, 33B, 33C, 33D and 33E are shown in FIG. 7. The operation of each detector circuit 33A–E is substantially identical.

Figure 8:
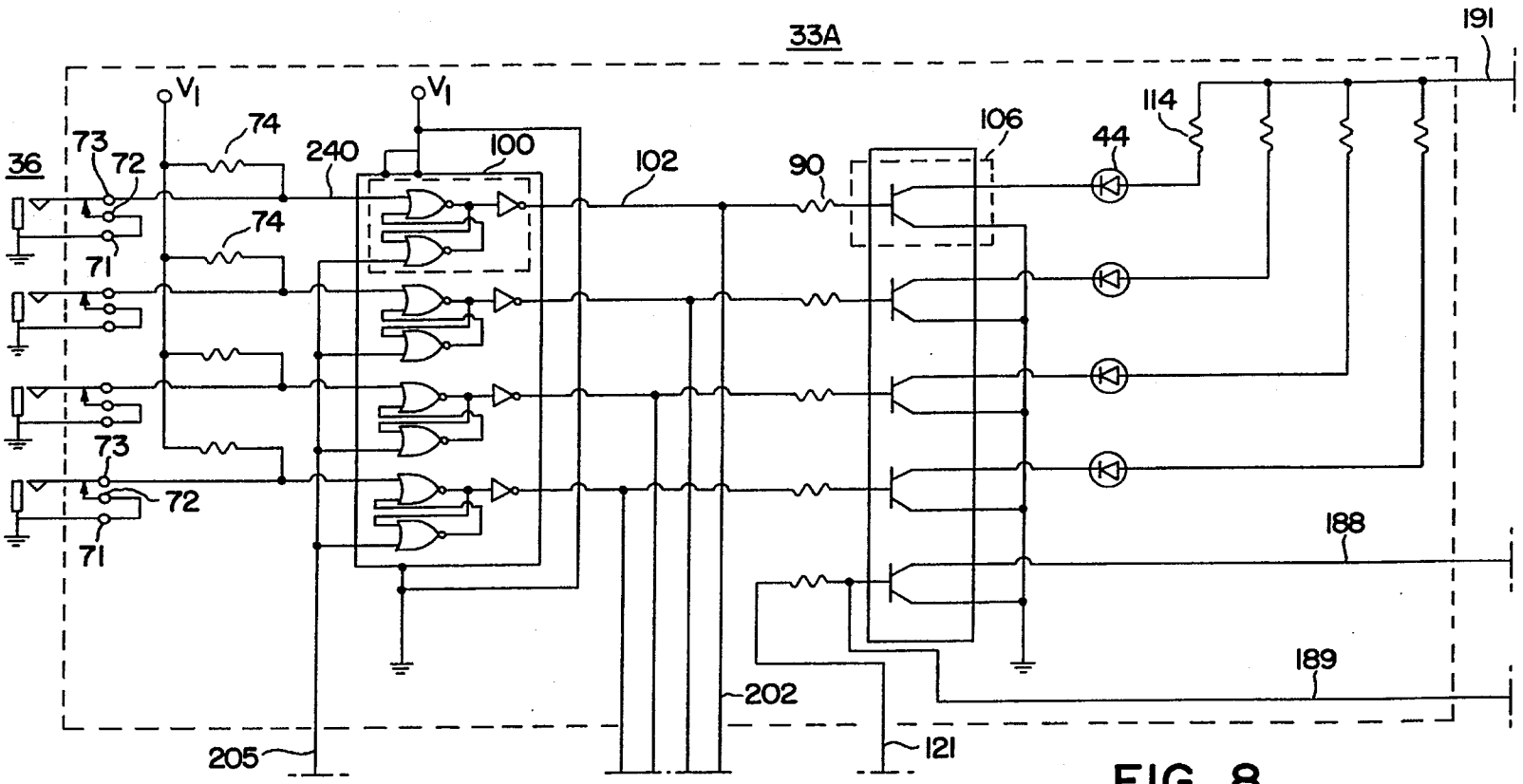
FIG. 8 is an enlarged schematic diagram of the detection and latch circuitry contained within the blocks of FIG. 7.
Figure 9:
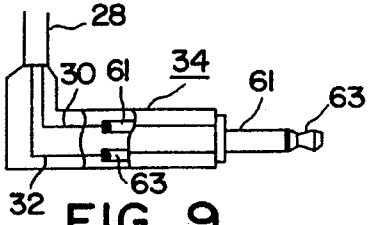
FIG. 9 is an enlarged sectional view of a plug used in connection with the present invention.

The schematic diagram of detector circuit 33A is shown in FIG. 8. Jack 36 having terminals 71, 72, 73 is shown. Jack 36 is a three-conductor normally closed jack. Terminal 72 makes with terminal 73 when there is no plug 34 inserted into jack 36. However, when plug 34 is inserted into jack 36, the electrical connection between terminals 72 and 73 is broken.

The plugs and jacks operate in the normal fashion, i.e. when plug 34 is fully inserted into jack 36, conductor 61 makes electrical contact with conductor 71, and conductor 63 makes electrical contact with conductor 73.

Terminal 71 is grounded. Terminal 72 is shorted to terminal 71. Conductor 73 is connected to resistor 74, typically at 6.2 megohm resistor; the other end of resistor 74 is connected to the supply voltage $V_1$. Supply voltage $V_1$ is nominally nine volts DC.

Connector 73 is also connected to the input 240 of latch 100. Latch 100 is a cross-coupled NOR set/reset latch. Various set/reset latches can be used; for example CD4043B is a common integrated circuit chip 115 which contains four set/reset latches 100. Chip 115 is connected in a normal manner including connections to the supply voltage and ground.

When the voltage appearing at the set input 240 of latch 100 is less than ⅓ of the $V_1$ supply voltage (a non-alarm condition) the output of the latch 100 will be low. When the voltage appearing at the set input 240 of latch 100 is greater than ⅔ of the $V_1$ supply voltage (a security breach), the output 102 of the latch 100 will go high and remains high.

Under normal operation in the ON or ARMED mode, current flows from the $V_1$ supply voltage through resistor 74, terminal 73, to terminal 72, to terminal 71 and to ground when no plug 34 is inserted into jack 36. This keeps set input 240 of latch 100 low. This feature eliminates the need for shunt plugs.

If plug 34 is inserted into jack 36 the internal connection between terminals 72 and 73 is broken. When there is not an alarm condition, the set input 240 of the latch 100 remains low, since a closed loop circuit through switch 50 is formed, and resistor 74 sources a current of approximately 1.5 microamps through the switch 50. The voltage level at the set input 240 of latch 100 will be approximately ground since current flows from $V_1$ through resistor 74, to terminal 73, to terminal 63, through wire 30, through switch 50, through wire 32, to terminal 61, to conductor 71 to ground. Accordingly, latch 100 will remain in the reset state. The voltage at the output 102 of the latch 100 will be low (ground); therefore, the corresponding housing LED 44, the alarm horn 126 and the indicator light 45 will all remain off.

If the jacket 21 is removed from the clip 24 (see FIG. 3), the actuator 48 distends and the switch 50 within the clip 24 will open circuit, thereby breaking the connection between wires 30 and 32. The voltage at the input 240 of the latch 100 will be pulled up approximately to the $V_1$ supply voltage (nine volts DC), through resistor 74. The latch 100 will be set and the output 102 of the latch 100 will go high. Similar results occur when item cord 28 is cut, since the detector circuit will again detect an open circuit, and input 240 will again be pulled high to the $V_1$ supply voltage.

The latch 100 ensures that the removal and reinsertion of plug 34, or the removal and reapplication of clip 24, will not reset the alarm circuitry. Accordingly, once a breach of security condition is detected, the alarm horn 126 will sound, and housing LED 44 and indicator light 45 will both illumiinate until an authorized person resets the security system (i.e., by unlocking lock 38 and raising lid 19).

The output 102 of the latch 100 is connected to resistor 90 and the other end of resistor 90 is connected to the base of transistor 106. Resistor 90 is typically a twenty kilohm resistor and limits the current flowing into transistor 106. Transistor 106 is a NPN transistor, for example part of a CA3083 integrated circuit transistor array.

The collector of transistor 106 is connected to the cathode of housing LED 44. The anode of LED 44 is connected to resistor 114. Resistor 114 is typically a one kilohm resistor. The other end of the resistor 114 is connected to the $V_1$ supply voltage via line 191. The emitter of transistor 106 is connected to ground.

When the output 102 of latch 100 goes high (i.e., during a security breach), transistor 106 is turned on. Current flows from the $V_1$ supply voltage through resistor 114, LED 44, transistor 106 to ground; this has the effect of turning LED 44 on.

The output 102 of latch 100 is also connected to an eight-input OR gate 120 as shown in FIG. 7 via line 202. OR gate 120 may be integrated circuit chip CD4078. The output 121 of OR gate 120 drives transistor 122 through resistor 127. Transistor 122 is a NPN transistor and can be part of the IC array 107. Resistor 127 is nominally a five kilohm resistor.

The emitter of transistor 122 is connected to ground while the collector is connected to the negative side of horn 126 via lead line. When all items 22 are secure (i.e. a non-alarm condition), all eight inputs of OR gate 120 are low. The output of OR gate 120 will also be low, keeping transistor 122 off, which in turn keeps horn 126 and indicator light 45 off.

During a security breach, the output 102 of latch 100 goes high. Since the input 202 of OR gate 120 is connected to output 102, the output 121 of the OR gate 120 goes high which turns on transistor 122; this in turn causes the horn 126 to sound and indicator light 45 to flash or blink.

The power for this circuit is supplied by a nine volt battery 226. A zener diode 123 and a capacitor 124 are wired in parallel across the battery terminals. The capacitor 124 filters any transients appearing on the $V_1$ supply line, while the zener diode 123 is used to limit the voltage to the integrated circuits due to an inadvertent high voltage. Diode 123 is typically a fifteen volt zener diode while capacitor 124 is nominally a 4.7 microfarad capacitor.

A power on and reset circuit is included. This circuit consists of diode 128, capacitor 182 and resistor 181. In the preferred embodiment, diode 128 is a 1N914 diode, capacitor 182 is a one microfarad capacitor, and resistor 181 is ten kilohms. This circuit is connected to the reset input 205 of latch 100. When lid 19 is opened, closing switch 210, a rising voltage is coupled to the reset input 205 of latch 100 through capacitor 182. The capacitor 182 and resistor 181 act as a differentiator providing a positive going voltage pulse to the latches 100. As long as the set input 240 is low and switch 210 is closed, the voltage pulse to reset input 205 will reset the output 202 of latch 100 (i.e. output 102 will be low). If an item 22 was removed from the jaws of clip 24, or if item cable 28 was cut, set input 240 will be high preventing the particular latch 100 from being reset. This keeps the corresponding housing LED 44 lit. The diode ensures that the capacitor 182 is quickly discharged when the battery 226 is removed from the circuit.

Battery test switch 232, as shown in FIGS. 1 and 7, is provided in order to check the condition of the battery 226. Switch 232 is normally open. Closing switch 232 connects the battery 226 to a resistor 291; the other end of resistor 291 is connected to the base of transistor 122 via line 189. Resistor 291 is nominally a five kilohm resistor. When switch 232 closes, current is supplied to the base of transistor 122, turning the transistor on. This in turn sounds the alarm horn 126 and turns on the indicator light 45.

The set-up of the alarm system by store personnel will now be described. Key 40 is used to open lock 38. Lid 19 is opened, actuator 81 rises off of flexible metal bars 211 and 213, distending the actuators of switches 210 and 212. (See FIGS. 1, 2A and 2B.) Switch 210 is a normally closed switch while switch 212 is a normally open switch. The security system 10 is now in its SET-UP mode. Since switch 212 is open, horn 126 and indicating light 45 are deactivated. Since switch 210 is closed, current flows from battery 226 resetting all twenty latches 100 via reset input 205.

Store personnel will choose the appropriate sensors and connect it to the items 22 to be protected. In this example, clips 24 is attached to the desired items 22. Since lid 19 is open, wire 28 can be threaded through semi-circular cut-out 91 of the housing 12. Plug 34 is then inserted into jack 36.

In the set-up mode, if the clip 24 is not properly attached to the item 22 or if there is an open circuit (e.g., a misconnection between plug 34 and jack 36), the housing LED 44 which corresponds to jack 36 will light. The store personnel must check plug 34 and jack 36 or ensure that item 22 depresses actuator 48 of switch 50. When the connection is properly made, the housing LED 44 will turn off. In the SET-UP mode, the horn 126 and indicator light 45 can not turn on since switch 212 is open.

When all of the desired items 22 are attached and their respective plugs 34 are inserted into jacks 36, lid 19 is closed. Plunger 81 of lid 19 depresses the flexible metal bars 211, 213 and the actuators of switches 210 and 212 are depressed. Switch 210 is now open; switch 212 is now closed which makes horn 126 and indicator light 45 operable. The security system is now in its ARMED state. Further, when lid 19 is closed, semi-circular cut-out 93 forms a securing clamp with semi-circular cut-out 91 to prevent the removal of plug 34 from jack 36.

If there is a security breach, the proper housing LED 44 lights, indicator light 45 begins to blink or flash and horn 126 sounds. The purpose of indicating light 45 is to alert store personnel from a distance. This is especially useful when there are several security systems 10 located near each other. It may be difficult to find the system 10 in which a security breach is detected if there is only an audio alarm.

The indicator light 45 is usually a large LED and can be seen from a distance. In the preferred embodiments, the LED can flash to enhance its ability to draw the attention of store personnel. Store personnel can go directly to the security circuit in which the breach has taken place. The housing LED 44 which corresponds to the clip 24 or cord 28 in which the security breach took place, will also light. Upon visual inspection, the store personnel can pinpoint the exact location of the security breach by noting which housing LED 44 is lit. If the security breach is the removal of clip 24, the reapplication of the clip 24 onto another item 22 or a foreign object, will not deactivate the alarm since latch 100 has been set. Latch 100 can only be reset by opening lid 19.

Figure 2A:
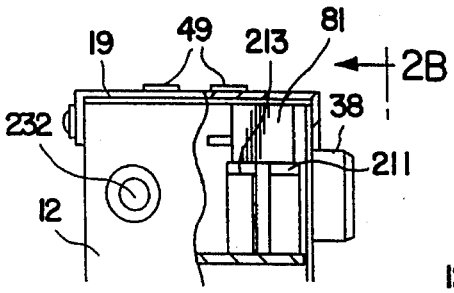
FIG. 2A is a slightly enlarged bottom plan view taken along line 2A—2A of FIG. 1, with the hinged lid in a closed position and a portion of the housing shown in section to more easily view the plunger engaging the activating switches in unison.
Figure 2B:
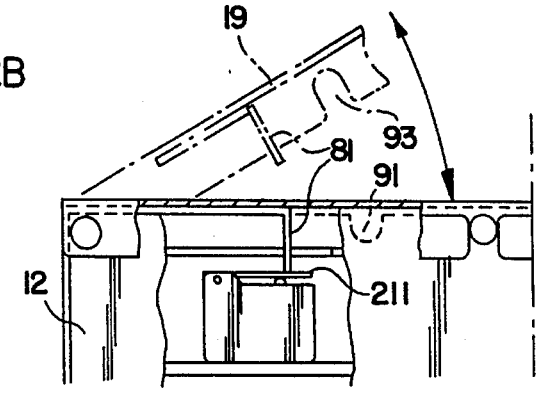
FIG. 2B is a fragmentary side elevational view taken along line 2B—2B of FIG. 2A, with a portion of the housing shown in section to more easily view the plunger engaging the activating switches, and including a fragment of the lid in dashed line in an intermediate opened position.

In reference to FIGS. 1 and 2B, after a security breach, the store personnel can turn the alarm horn 126 off by opening lock 38 and raising lid 19. When the lid 19 is open, horn 126 and indicator light 45 are deactivated since switch 212 will open. However, the housing LED 44 which corresponds to the security breach will stay lit, if switch 50 remains open or cable 28 was cut. When the lid 19 is open, the insertion of item 22 into clip 24, i.e., the closing of switch 50, will turn the housing LED 44 off.

The lid 19 also prevents tampering since it restricts access to the jacks 36. Accordingly, foreign objects cannot be inserted into jacks 36. When lid 19 is closed, plug 34 cannot be removed from jack 36. This prevents the accidental removal of plug 34 from jack 36 since lid 19 holds the plug 34 securely in place. Similarly, it prevents the unauthorized removal of plug 34 from jack 36, thwarting the attempts of a potential thief. However, view ports 49 allow the visual inspection of housing LEDS 44.

While the invention has been particularly shown and described with reference to a preferred embodiment thereof, it is to be understood by those skilled in the art that various changes in form and details may be made therein without departing from the spirit and scope of the invention.

What is claimed is:

1. A security device for merchandise and the like comprising:

a. a sensor circuit attached to each item of merchandise to be protected, the sensor circuit including:

i. an alarm signal generation means having at least a secure state and an alarm state; and ii. electrical conductors connected to the alarm signal generation means at one end and having conducting means at the other, for communicating the state of the sensor; and iii. a lid that places the alarm means in a set-up mode when open and places the alarm means in an armed mode when closed, whereby in the set-up mode when a security breach is detected, the housing LEDs indicate an improper connection and the audio alarm means is deactivated, and when in the armed mode, the audio alarm means is able to sound upon the detection of the security breach means, b. connection means for connecting to the conducting means;

c. security means for insuring that the conducting means keeps continual electrical contact with the connection means;

d. detection means connected to the connection means for determining the state of the alarm signal generation means and the integrity of the electrical conductors; and e. an alarm connected to the detection means and which is activated upon the detection of the alarm state.

2. The device of claim 1 comprising housing LED corresponding to each cable or sensor, connected to the detection means, for indicating the secure state and the alarm state of each sensor.

3. The device of claim 1 wherein the alarm signal generation means comprises a switch.

4. The device of claim 1 wherein the alarm signal generation means comprises a conductive sensor loop designed to pass through a portion of the item of merchandise to be secured, and having a slip loop at one end in which the connecting end can pass through, whereby the unauthorized removal of the item requires disconnection of the slip loop generating the alarm signal.

5. The device of claim 1 wherein the conducting means is a plug and the connection means is a jack for receiving the plug.

6. The device of claim 5 wherein the jack is a normally closed jack thereby providing the proper connections when no plug is inserted into the jack.

7. The device of claim 1 further comprising a flashing indicating light operatively connected to the detection means for alerting store personnel of a security breach.

8. A security device for merchandise and the like comprising:

a. a sensor circuit attached to each item of merchandise to be protected, the sensor circuit including:

i. an alarm signal generation means having at least a secure state and an alarm state; and ii. electrical conductors connected to the alarm signal generation means at one end and having conducting means on the other end, for communicating the state of the sensor;

b. an alarm means for sounding an alarm upon the detection of a security breach, the alarm means including:

i. detection means connected to the conducting means for determining the state of the alarm signal generation means and the integrity of the electrical conductor;

ii. an audio alarm means that sounds upon the detection of a security breach;

iii. a visual alarm means located next to every connection to the conducting means that lights when the security breach occurs in that respective sensor circuit; and iv. a lid that places the alarm means in a set-up mode when open and places the alarm means in an armed mode when closed, whereby in the set-up mode when a security breach is detected, the housing LEDs indicate an improper connection and the audio alarm means is deactivated, and when in the armed mode, the audio alarm means is able to sound upon the detection of the security breach.

9. The device of claim 8 wherein the sensor circuit is an electronic clip.

10. The device of claim 8 wherein the sensor circuit is an electronic cable loop.

11. The device of claim 8 wherein the lid prevents tampering with the conducting means.

12. The device of claim 8 further comprising a latch circuit connected to the detection means which prevents an unauthorized resetting of the audio alarm means and the video alarm means once the security breach has been detected.

13. The device of claim 12 further comprising a switch means activated upon the opening of the lid; and a reset circuit which resets the latch circuit.

* * * * *